US011952768B1

(12) United States Patent
Liu et al.

(10) Patent No.: US 11,952,768 B1
(45) Date of Patent: Apr. 9, 2024

(54) FABRICATED CONCRETE CONNECTION STRUCTURE AND CONSTRUCTION METHOD

(71) Applicant: North China University of Science and Technology, Hebei (CN)

(72) Inventors: Bo Liu, Hebei (CN); Juannong Chen, Hebei (CN); Lin Gao, Hebei (CN); Yankai Lu, Hebei (CN)

(73) Assignee: North China University of Science and Technology, Tangshan (CN)

( * ) Notice: Subject to any disclaimer, the term of this patent is extended or adjusted under 35 U.S.C. 154(b) by 0 days.

(21) Appl. No.: 18/527,067

(22) Filed: Dec. 1, 2023

Related U.S. Application Data

(63) Continuation of application No. PCT/CN2023/011735, filed on Sep. 6, 2023.

(30) Foreign Application Priority Data

Oct. 19, 2022 (CN) ..... 202211281614.2

(51) Int. Cl.
*E04B 1/04* (2006.01)

(52) U.S. Cl.
CPC ..... *E04B 1/043* (2013.01)

(58) Field of Classification Search
None
See application file for complete search history.

(56) References Cited

U.S. PATENT DOCUMENTS

2022/0049488 A1* 2/2022 Dombowsky ..... E04B 1/14
2022/0127838 A1* 4/2022 Fukuda ..... E04B 1/4121

FOREIGN PATENT DOCUMENTS

CN 109750793 A 5/2019
CN 115434451 A 12/2022

* cited by examiner

*Primary Examiner* — Joshua K Ihezie

(57) ABSTRACT

The present disclosure relates to a fabricated concrete connection structure and a construction method, the structure including shear wall members. Tops of the shear wall members are fixedly connected to a plurality of connection female heads, and the plurality of connection female heads are arranged at equal intervals along length directions of the shear wall members. Reinforcing cage pre-formed holes penetrate through the tops and bottoms of the shear wall members. A plurality of connection male heads are arranged at equal intervals along the length directions of the shear wall members, and the plurality of connection male heads are in one-to-one correspondence with the plurality of connection female heads. One sides of the bottoms of the shear wall members are fixedly connected to folding plates. The present disclosure can achieve the purpose of connecting the shear wall members conveniently and quickly, improving the efficiency and quality of construction.

9 Claims, 3 Drawing Sheets

FABRICATED CONCRETE CONNECTION STRUCTURE AND CONSTRUCTION METHOD

CROSS-REFERENCE TO RELATED APPLICATIONS

This application is a continuation of PCT/CN/2023/117352, filed Sep. 6, 2023 and claims priority of Chinese Patent Application No. 202211281614.2, filed on Oct. 19, 2022, the entire contents of which are incorporated herein by reference.

TECHNICAL FIELD

The present disclosure relates to the technical field of construction engineering, in particular to a fabricated concrete connection structure and a construction method.

BACKGROUND

At this stage, as China vigorously promotes the housing industrialization, and based on China's population, high-rise residential buildings are still the main types of civil construction currently. For the high-rise residential buildings, shear wall structures have been mainly selected in the high-rise residential buildings at present due to the application of the shear wall structure making the high-rise residential buildings have good seismic resistance and economy. A fabricated building adopts a method of factory prefabrication and on-site assembly, which greatly reduces a construction cycle of the high-rise residential buildings, and the mass production can significantly reduce the cost of building manufacturing. Therefore, a number of fabricated residential projects have been carried out across China.

However, China is still in the initial stage of the development of fabricated buildings with many technologies introduced from abroad. The technology is complex, especially in the assembly process, it is necessary to hoist, align, connect and reinforce shear wall members, resulting in cumbersome processes and an immature application. The complex process makes the construction quality far from meeting the specification requirements, so that the fabricated construction fails to achieve high efficiency. Therefore, there is an urgent need for a fabricated concrete connection structure and a construction method to solve the problems.

SUMMARY

An objective of the present disclosure is to provide a fabricated concrete connection structure and a construction method to solve the above problems, achieving the purpose of connecting shear wall members conveniently and quickly, and improving the efficiency and quality of construction.

To achieve the above objective, the present disclosure provides the following solutions.

A fabricated concrete connection structure, including shear wall members, tops of the shear wall members being fixedly connected to a plurality of connection female heads, and the plurality of connection female heads being arranged at equal intervals along length directions of the shear wall members; a plurality of reinforcing cage pre-formed holes being disposed on the shear wall members, the plurality of reinforcing cage pre-formed holes being disposed at equal intervals along the length directions of the shear wall members, the plurality of reinforcing cage pre-formed holes and the plurality of connection female heads being arranged at intervals, and the reinforcing cage pre-formed holes penetrating through the tops and bottoms of the shear wall members; a plurality of connection male heads being arranged at the bottoms of the shear wall members, the plurality of connection male heads being arranged at equal intervals along the length directions of the shear wall members, and the plurality of connection male heads being in one-to-one correspondence with the plurality of connection female heads; and one side of the bottom of each of the shear wall members being fixedly connected to a folding plate;

each of the connection female heads includes a female head connection seat, and the female head connection seat is fixedly connected to the top of the shear wall member; and one side of the female head connection seat is fixedly connected to a first reinforcing steel joint, the other side of the female head connection seat is fixedly connected to a first sleeve pipe, a fastening part is sleeved on an outer side of the first sleeve pipe, and an inner wall of the fastening part is slidably connected to an outer wall of the first sleeve pipe;

a second sleeve pipe is sleeved inside the first sleeve pipe, and an outer wall of the second sleeve pipe is fixedly connected to an inner wall of the first sleeve pipe; a plurality of open grooves are disposed at one end of the second sleeve pipe, the plurality of open grooves are disposed at equal intervals along a circumference of the second sleeve pipe, a plurality of clamp beads are connected inside the open grooves in a clamping mode, and the plurality of clamp beads are connected to the fastening part in a clamping mode; and the outer wall of the second sleeve pipe is slidably connected to the inner wall of the fastening part;

an inner wall of the second sleeve pipe is slidably connected to a first sliding part, an inner wall of the first sliding part is slidably connected to a fourth sleeve pipe, and one end of the fourth sleeve pipe is fixedly connected to a side wall of the female head connection seat;

an inner wall of the fourth sleeve pipe is fixedly connected to a third sleeve pipe, an inner wall of the third sleeve pipe is slidably connected to a second sliding part, a connection rod is arranged in a center of the second sliding part, one end of the connection rod is fixedly connected to a center of the side wall of the female head connection seat, the other end of the connection rod is fixedly connected to a first push block, a side wall of the first push block abuts against the second sliding part, and a top of one end of the second sliding part is slidably connected to the inner wall of the first sliding part; and a first sealing ring is arranged on the inner wall of the third sleeve pipe, and the first sealing ring is arranged in contact with a side wall of the second sliding part.

Further, the fastening part includes a sliding ring, one end of the sliding ring being fixedly connected to a first connection sleeve; a middle portion of the sliding ring abutting against one ends of first springs, and the other ends of the first springs abutting against an end portion of the first sleeve pipe; an inner wall of the sliding ring being slidably connected to the outer wall of the first sleeve pipe; an inner wall, away from the first sleeve pipe, of one side of the sliding ring being slidably connected to the outer wall of the second sleeve pipe; and a plurality of keep-space grooves being disposed at equal intervals along a circumference at one end, away from the first sleeve pipe, of the sliding ring, the plurality of keep-space grooves being in one-to-one correspondence with the plurality of open grooves, and the keep-space groove being connected to the clamp bead in a clamping mode.

Further, the first sliding part includes a first sliding ring, second springs being arranged at one end of the first sliding ring, and two ends of each of the second springs abutting against an end portion of the first sliding ring and one side of the female head connection seat; an outer wall of the first sliding ring being slidably connected to the inner wall of the second sleeve pipe and an inner wall of the first sliding ring being slidably connected to the top of one end of the second sliding part and being slidably connected to an outer wall of the fourth sleeve pipe.

Further, the second sliding part includes a second sliding ring, a ring-shaped plate being sleeved outside the second sliding ring, the ring-shaped plate being positioned at a middle portion of the second sliding ring, and the second sliding ring being fixedly connected to the ring-shaped plate; and third springs being arranged on one side of the ring-shaped plate, and two ends of each of the third springs abutting against one end of the third sleeve pipe and one side of the ring-shaped plate; an outer wall of the second sliding ring being slidably connected to the inner wall of the third sleeve pipe; and an outer wall of the ring-shaped plate being slidably connected to an inner wall of the first sliding ring.

Further, each of the connection male heads includes a sixth sleeve pipe, a fifth sleeve pipe being sleeved on an outer wall of the sixth sleeve pipe, one end of the fifth sleeve pipe being fixedly connected to a second connection sleeve, and the second connection sleeve being sleeved on an outer side of the sixth sleeve pipe; one end of the sixth sleeve pipe being fixedly connected to a second push block, the other end of the sixth sleeve pipe being fixedly connected to a fixed support, and an outer wall of the fixed support being fixedly connected to an inner wall of the fifth sleeve pipe;

a center of the fixed support being fixedly connected to a seventh sleeve pipe, an inner side of a middle portion of the seventh sleeve pipe being fixedly connected to a fixed plate, one side of the fixed plate being elastically connected to a connection part, and one end of the connection part being slidably connected to an inner wall of the second push block; a lifting part being arranged on the other side of the fixed plate, one end of the lifting part being rotatably connected to the fixed plate, the other end of the lifting part being fixedly connected to a second reinforcing steel joint, the second reinforcing steel joint penetrating through the fifth sleeve pipe, an outer wall of the second reinforcing steel joint being slidably connected to the inner wall of the fifth sleeve pipe and being fixedly connected to a wall-connecting plate, the wall-connecting plate being positioned on an outer side of the fifth sleeve pipe, and the wall-connecting plate being fixedly connected to the bottom of the shear wall member; and the inner wall of the second push block being fixedly embedded with a second sealing ring, and the second sealing ring being slidably connected to one end of the connection part; and an open hole being disposed on a side wall, close to the second reinforcing steel joint, of one end of the fifth sleeve pipe, and the open hole being threadedly connected to a screw piston.

Further, the connection part includes a sliding rod, the sliding rod being slidably connected to the inner wall of the second push block and the second sealing ring, a middle portion of the sliding rod being fixedly connected to a limit ring, the limit ring being a conical cavity structure, the seventh sleeve pipe being positioned between an inner wall of the limit ring and an outer wall of the sliding rod, and the outer wall of the sliding rod being fixedly connected to an inner wall of the seventh sleeve pipe; and fourth springs being arranged between one end of the sliding rod and the fixed plate, and two ends of each of the fourth springs abutting against one end of the sliding rod and a side wall of the fixed plate.

Further, the lifting part includes a threaded rod, one end of the threaded rod being rotatably connected to the side wall of the fixed plate, and the other end of the threaded rod being rotatably connected to the center of the fixed support; a middle portion of the threaded rod being fixedly connected to a second bevel gear, the second bevel gear being meshed with a first bevel gear, a middle portion of the first bevel gear being fixedly connected to an adjustment pin, and the adjustment pin penetrating through a side wall of the fifth sleeve pipe and a side wall of the sixth sleeve pipe; and one side, close to the fixed support, of the threaded rod being threadedly connected to a threaded sliding block, a side wall of the threaded sliding block being slidably connected to the inner wall of the seventh sleeve pipe, one side, away from the second bevel gear, of the threaded sliding block being fixedly connected to a plurality of push rods at equal intervals along a circumference, the push rods penetrating through the fixed support, end portions of the plurality of push rods being fixedly connected to one side of a same third sliding block, a side wall of the third sliding block being slidably connected to the inner wall of the fifth sleeve pipe, and the other side of the third sliding block being fixedly connected to the second reinforcing steel joint.

A construction method for a fabricated concrete connection structure based on a fabricated concrete connection structure, including the following steps:

S1. hoisting a shear wall member directly above the other shear wall member, and allowing a plurality of connection female heads to be in one-to-one correspondence with a plurality of connection male heads;

S2. lowering a height of the shear wall member to allow a bottom of a folding plate at a bottom of the shear wall member to be in contact with a top of the other shear wall member, and inserting the connection male heads into the connection female heads at the same time, followed by fixedly connecting the connection male heads to the connection female heads;

S3. measuring levelness of the shear wall member, and leveling the shear wall member by adjusting the plurality of connection male heads;

S4. fixing the shear wall member by mounting a formwork on the shear wall member;

S5. injecting cement paste into the connection female heads and the connection male heads, and removing the formwork of the shear wall member after the cement paste solidifies;

S6. placing reinforcing cages into reinforcing cage pre-formed holes; and

S7. mounting the formwork at an edge of a gap between the upper and lower shear wall members, pouring concrete into the shear wall member through the reinforcing cage pre-formed holes to fill the gap between the two shear wall members, and removing the formwork after the concrete solidifies to complete the construction.

The present disclosure has the following technical solutions: when in use, the shear wall member is hoisted directly above the other shear wall member to allow a plurality of connection female heads to be in one-to-one correspondence with a plurality of connection male heads; then the height of the shear wall member is lowered to allow the bottom of the folding plate at the bottom of the shear wall member to be in contact with the top of the other shear wall member; at the same time, the connection male head is inserted into the connection female head so that the two can be connected and fixed quickly, greatly speeding the connection of the two shear wall members and the mounting of the shear wall members; and at the same time, the connection male head and the connection female head can be connected easily and fixed simply, which can be learned in a low cost and operated by construction workers conveniently.

Figure 1:
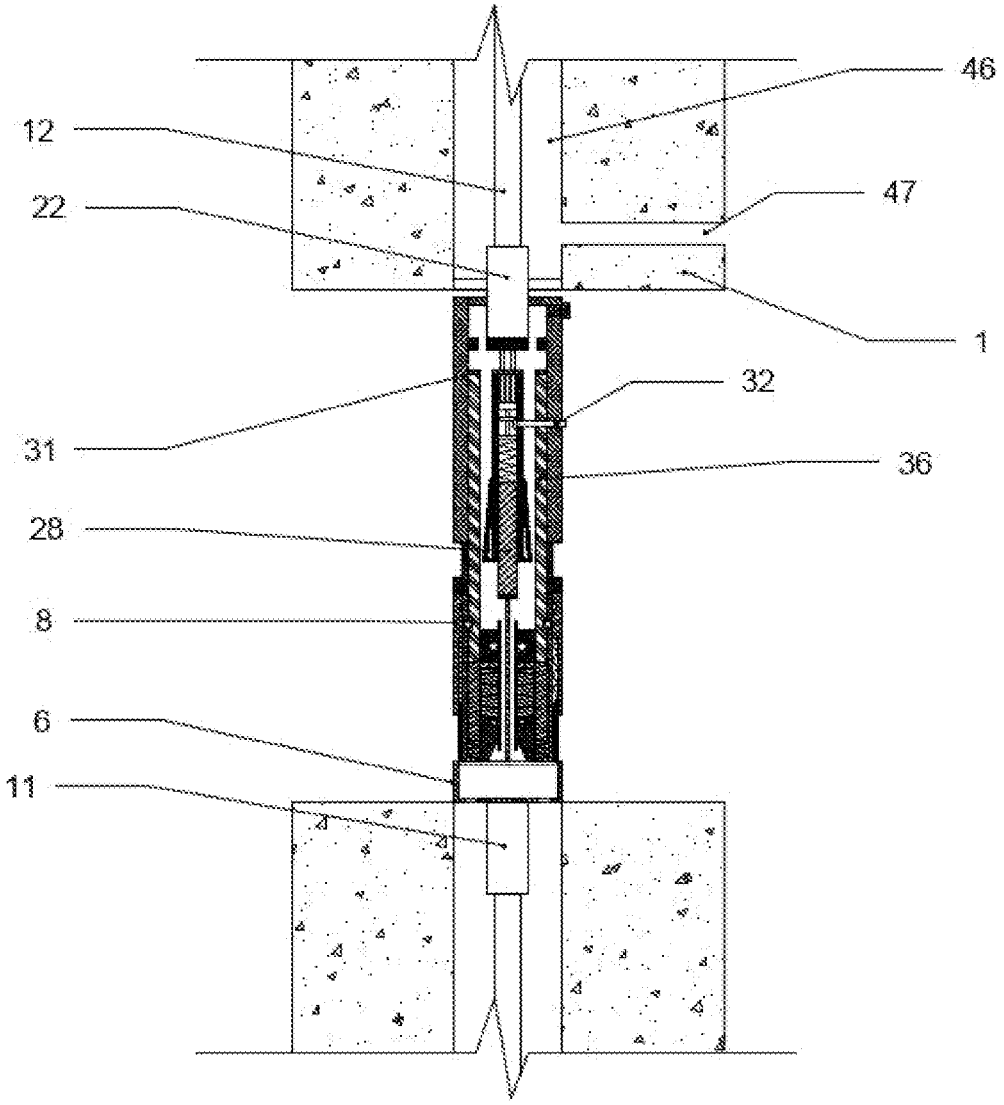
FIG. 1 is a structural schematic diagram of a fabricated concrete connection structure according to the present disclosure.

Reference numerals and denotations thereof: 1—shear wall member; 2—connection female head; 3—connection male head; 4—reinforcing cage pre-formed hole; 5—folding plate; 6—female head connection seat; 7—first sleeve pipe; 8—sliding ring; 9—first connection sleeve; 10—second sleeve pipe; 11—first reinforcing steel joint; 12—reinforcing steel; 13—clamp bead; 14—first spring; 15—second spring; 16—first sliding ring; 17—second sliding ring; 18—first push block; 19—connection rod; 20—third sleeve pipe; 21—fourth sleeve pipe; 22—second reinforcing steel joint; 23—third spring; 24—first sealing ring; 25—push rod; 26—second push block; 27—second sealing ring; 28—sliding rod; 29—limit ring; 30—second connection sleeve; 31—fifth sleeve pipe; 32—adjustment pin; 33—threaded piston; 34—wall-connecting plate; 35—third sliding block; 36—sixth sleeve pipe; 37—fixed support; 38—seventh sleeve pipe; 39—fourth spring; 40—fixed plate; 41—first bevel gear; 42—second bevel gear; 43—threaded rod; 44—threaded sliding block; 45—ring-shaped plate; 46—joint pre-formed hole; and 47—injected hole.

DETAILED DESCRIPTION

The present disclosure is further described by reference to the accompanying drawings and specific embodiment below.

Figure 2:
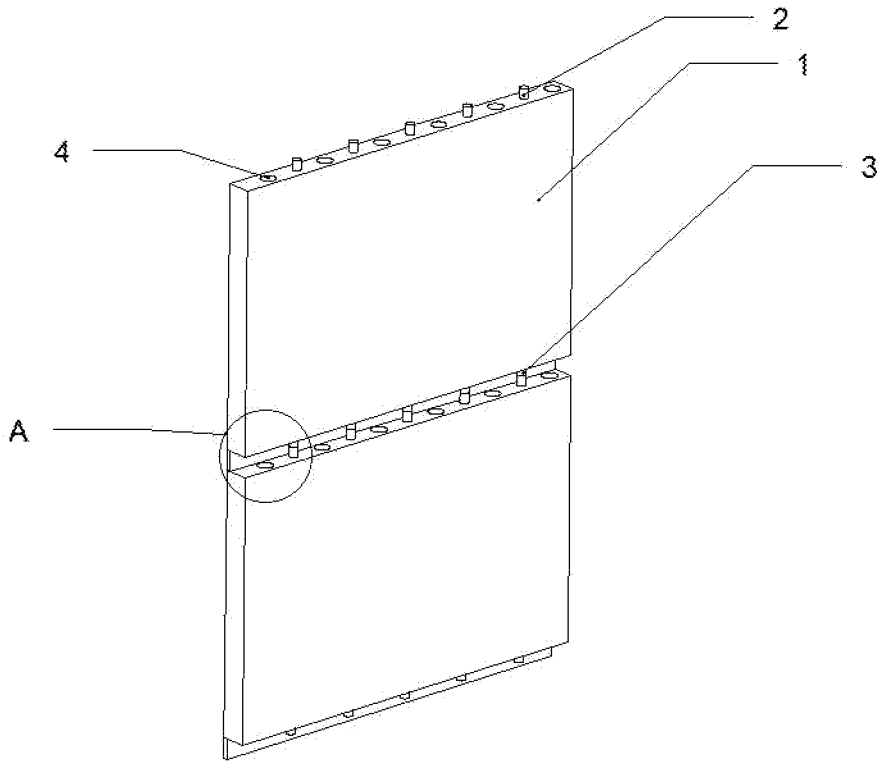
FIG. 2 is a schematic diagram of the connection of shear wall members according to the present disclosure.
Figure 3:
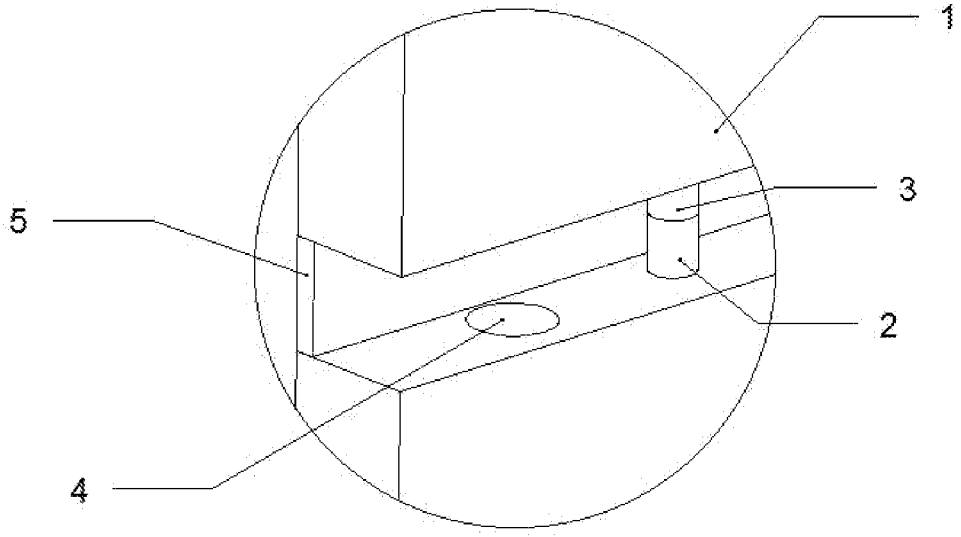
FIG. 3 is a partial enlargement view of portion A in FIG. 2 according to the present disclosure.
Figure 4:
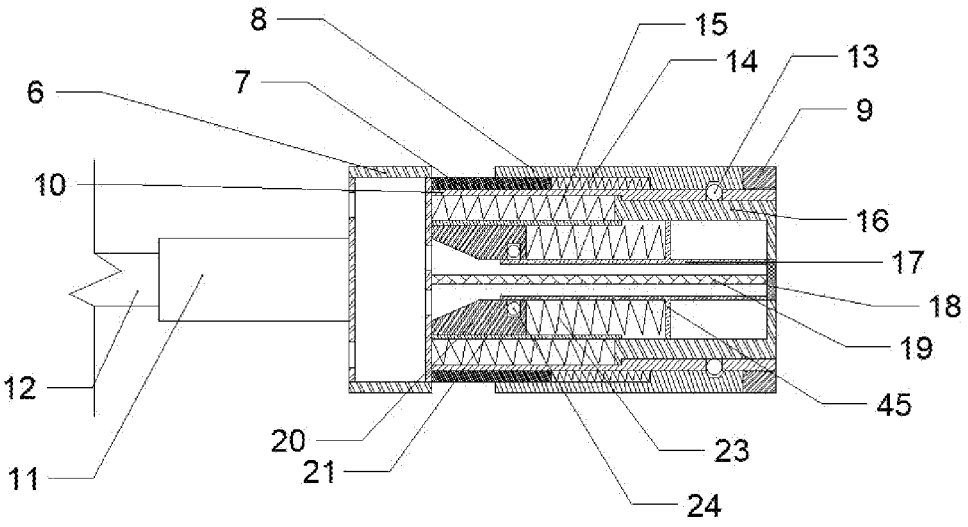
FIG. 4 is a cross-sectional view of a connection female head according to the present disclosure.
Figure 5:
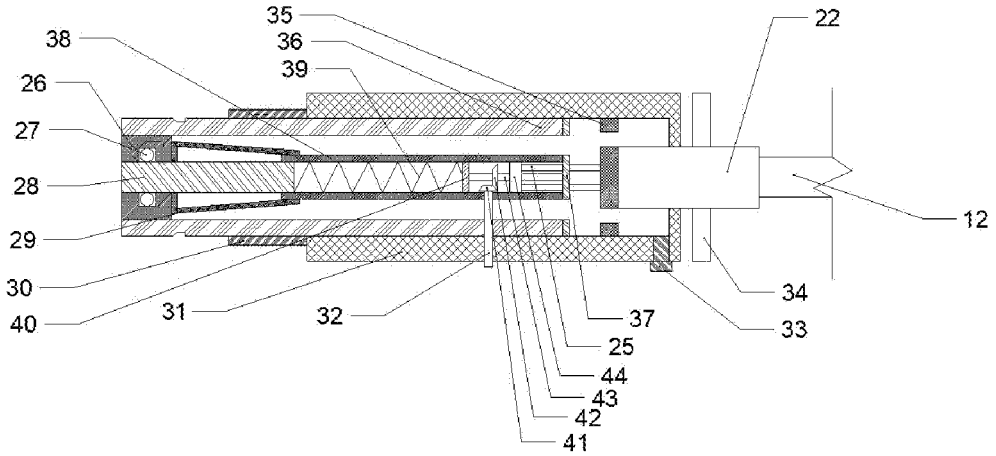
FIG. 5 is a cross-sectional view of a connection male head according to the present disclosure.
Figure 6:
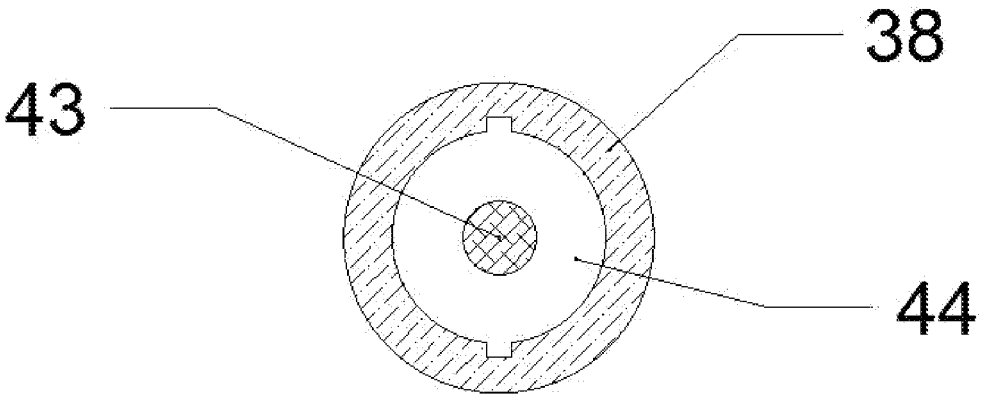
FIG. 6 is a schematic diagram of the connection of a threaded sliding block and a seventh sleeve pipe according to the present disclosure.

Referring to FIGS. 1-6, the present disclosure provides a fabricated concrete connection structure, including shear wall members 1. Tops of the shear wall members 1 are fixedly connected to a plurality of connection female heads 2, and the plurality of connection female heads 2 are arranged at equal intervals along length directions of the shear wall members 1. A plurality of reinforcing cage pre-formed holes 4 are disposed on the shear wall members 1, the plurality of reinforcing cage pre-formed holes 4 are disposed at equal intervals along the length directions of the shear wall members 1, the plurality of reinforcing cage pre-formed holes 4 and the plurality of connection female heads 2 are arranged at intervals, and the reinforcing cage pre-formed holes 4 penetrate through the tops and bottoms of the shear wall members 1. A plurality of connection male heads 3 are arranged at the bottoms of the shear wall members 1, the plurality of connection male heads 3 are arranged at equal intervals along the length directions of the shear wall members 1, and the plurality of connection male heads 3 are in one-to-one correspondence with the plurality of connection female heads 2. One side of the bottom of each of the shear wall members 1 is fixedly connected to a folding plate 5.

When in use, the shear wall member 1 is hoisted directly above the other shear wall member 1 to allow the plurality of connection female heads 2 to be in one-to-one correspondence with the plurality of connection male heads 3, and then a height of the shear wall member 1 is lowered to allow the bottom of the folding plate 5 at the bottom of the shear wall member 1 to be in contact with the top of the other shear wall member 1. At the same time, the connection male head 3 is inserted into the connection female head 2 so that the two can be connected and fixed quickly, greatly speeding the connection of the two shear wall members 1 and the mounting of the shear wall member 1. At the same time, the connection male head 3 and connection female head 2 can be connected easily and fixed simply, which can be learned in a low cost and operated by construction workers conveniently.

The folding plate 5 at the bottom of the shear wall member 1 is positioned on one side of the bottom of the shear wall member 1, and a height of the folding plate 5 is the same as that of the connection female head 2 and the connection male head 3 after being connected. The folding plate 5 is fitted with the connection female head 2 and the connection male head 3 to support the shear wall member 1, avoiding the use of a large number of fixed devices to fix the shear wall member 1, and lowering the construction cost.

A supporting foot at the bottom of a traditional shear wall member 1 is a small pure concrete structure, and due to lack of reinforcing steel inside the supporting foot, the supporting foot is vulnerable to breakage during transportation or use and therefore is unable to provide support. When the folding plate 5 at the bottom of the shear wall member 1 of the present disclosure is manufactured, a reinforcing steel on one side of the shear wall member 1 can be extended and bent, and subsequently cast as a whole, which ultimately makes the folding plate 5 contain the reinforcing steel, greatly enhancing the strength of the folding plate 5, so that the folding plate 5 can provide stable support.

The shear wall member 1 is disposed with a plurality of joint re-formed holes 46, the plurality of joint re-formed holes 46 are disposed at intervals from the plurality of reinforcing cage pre-formed holes 4, and the joint pre-formed holes 46 run through the tops and bottoms of the shear wall member 1. The connection female heads 2 and the connection male heads 3 are positioned at tops and bottoms of the joint pre-formed holes 46, respectively. The connection female heads 2 and the connection male heads 3 are fixedly connected via reinforcing steels 12. The joint pre-formed holes 46 are disposed on side walls of one ends of the connection male heads 3, and injected holes 47 are also disposed on the side walls of one ends of the connection male heads 3, and the joint pre-formed holes 46 are connected to the outside through the injected holes 47. After the upper and lower shear wall members 1 are connected, cement paste is injected into the joint re-formed hole 46 through the injected hole 47 disposed on the lower shear wall member 1. After the joint pre-formed hole 46 is filled with the cement paste, the cement paste is filled into the connection female head 2 and the connection male head 3. After the connection female head 2 and the connection male head 3 are filled with the cement paste, the excessive cement paste is discharged through the connection male head 3. After that, the cement paste is continued to be injected into for some time after blocking a discharge port of the connection male head 3 to ensure the sufficient cement paste. Then the injected hole 47 is blocked, and a formwork of the shear wall member 1 can be removed after the cement paste solidifies, completing the preliminary connection of the shear wall member 1.

In a further optimized solution, each of the connection female heads 2 includes a female head connection seat 6. The female head connection seat 6 is fixedly connected to the top of the shear wall member 1. One side of the female head connection seat 6 is fixedly connected to a first reinforcing steel joint 11, and the other side of the female head connection seat 6 is fixedly connected to a first sleeve pipe 7. A fastening part is sleeved on an outer side of the first sleeve pipe 7, and an inner wall of the fastening part is slidably connected to an outer wall of the first sleeve pipe 7.

A second sleeve pipe 10 is sleeved inside the first sleeve pipe 7. An outer wall of the second sleeve pipe 10 is fixedly connected to an inner wall of the first sleeve pipe 7. A plurality of open grooves are disposed at one end of the second sleeve pipe 10, and the plurality of open grooves are disposed at equal intervals along a circumference of the second sleeve pipe 10. A plurality of clamp beads 13 are connected inside the open grooves in a clamping mode, and the plurality of the clamp beads 13 are connected to the fastening part in a clamping mode. The outer wall of the second sleeve pipe 10 is slidably connected to the inner wall of the fastening part.

An inner wall of the second sleeve pipe 10 is slidably connected to a first sliding part, an inner wall of the first sliding part is slidably connected to a fourth sleeve pipe 21, and one end of the fourth sleeve pipe 21 is fixedly connected to a side wall of the female head connection seat 6.

An inner wall of the fourth sleeve pipe 21 is fixedly connected to a third sleeve pipe 20. An inner wall of the third sleeve pipe 20 is slidably connected to a second sliding part. A connection rod 19 is arranged in a center of the second sliding part. One end of the connection rod 19 is fixedly connected to a center of the side wall of the female head connection seat 6, and the other end of the connection rod 19 is fixedly connected to a first push block 18. A side wall of the first push block 18 abuts against the second sliding part. A top of one end of the second sliding part is slidably connected to the inner wall of the first sliding part.

A first sealing ring 24 is arranged on the inner wall of the third sleeve pipe 20, and the first sealing ring 24 is arranged in contact with a side wall of the second sliding part.

The female head connection seat 6 is a cavity and is disposed with holes on left and right side walls to communicate an interior of the connection female head 2 with the joint pre-formed hole 46, facilitating the inflow of the cement paste to fill the connection female head 2. The first reinforcing steel joint 11 on one side of the female head connection seat 6 is configured to connect one end of the reinforcing steel 12, and a suitable first reinforcing steel joint 11 can be selected according to a diameter of the reinforcing steel 12 to be connected. The fastening part sleeved on the outer side of the first sleeve pipe 7 is configured to fixedly connect the connection female head 2 and the connection male head 3.

A plurality of open grooves are disposed at one end of the second sleeve pipe 10, and the plurality of open grooves are disposed at equal intervals along a circumference of the second sleeve pipe 10. The number of the open grooves in the example is at least two. The clamp bead 13 is located inside the open groove disposed at one end of the second sleeve pipe 10, and the clamp bead 13 is connected to the fastening part in a clamping mode and is configured to fix the fastening part when the connection female head 2 is not connected to the connection male head 3.

When the connection male head 3 pushes the first sliding part to slide along the inner wall of the fourth sleeve pipe 21, the first sliding part slides to cause the connection male head 3 to stretch in, and then an inner wall of one end of the first sliding part comes into contact with a middle portion of the second sliding part, causing the first sliding part to push the second sliding part to continue to move towards the side of the connection female head 2 close to the female head connection seat 6, so that the connection female head 2 and the connection male head 3 is communicated internally.

In a further optimized solution, the fastening part includes a sliding ring 8. One end of the sliding rings 8 is fixedly connected to a first connection sleeve 9. A middle portion of the sliding ring 8 abuts against one ends of first springs 14, and the other ends of the first springs 14 abut against an end portion of the first sleeve pipe 7. An inner wall of the sliding ring 8 is slidably connected to the outer wall of the first sleeve pipe 7. An inner wall, away from the first sleeve pipe 7, of one side of the sliding ring 8 is slidably connected to the outer wall of the second sleeve pipe 10. A plurality of keep-space grooves are disposed at equal intervals along a circumference at one end, away from the first sleeve pipe 7, of the sliding ring 8. The plurality of keep-space grooves are in one-to-one correspondence with the plurality of open grooves, and the keep-space groove is connected to the clamp bead 13 in a clamping mode.

The keep-space groove is clamped with the clamp bead 13 so that the sliding ring 8 is clamped with the second sleeve pipe 10, avoiding the relative displacement between the sliding ring 8 and the second sleeve pipe 10. Upon the connection male head 3 stretches into, the keep-space groove is separated from the clamp bead 13, and at this moment, the sliding ring 8 moves relatively to the second sleeve pipe 10 under the action of the first spring 14, causing the first connection sleeve 9 to stretch onto the connection male head 3 and to be fixedly connected to the connection male head 3. Threads are arranged on an inner side of the first connection sleeve 9.

In the present disclosure, the first spring 14 is sleeved on the outer side of the second sleeve pipe 10, a plurality of first springs 14 can also be arranged at equal intervals along a circumstance of the outer side of the second sleeve pipe 10, and the number of the first springs is at least two.

In a further optimized solution, the first sliding part includes a first sliding ring 16. Second springs 15 are arranged at one end of the first sliding ring 16, and two ends of each of the seconds 15 abut against an end portion of the first sliding ring 16 and one side of the female head connection seat 6. An outer wall of the first sliding ring 16 is slidably connected to the inner wall of the second sleeve pipe 10. An inner wall of the first sliding ring 16 is slidably connected to the top of one end of the second sliding part and is slidably connected to an outer wall of the fourth sleeve pipes 21.

In a further optimized solution, the second sliding part includes a second sliding ring 17. A ring-shaped 45 is sleeved outside the second sliding ring 17, the ring-shaped plate 45 is positioned at a middle portion of the second sliding ring 17, and the second sliding ring 17 is fixedly connected to the ring-shaped plate 45.

Third springs 23 are arranged on one side of the ring-shaped plate 45. Two ends of each of the third springs 23 abut against one end of the third sleeve pipe 20 and one side of the ring-shaped plate 45. An outer wall of the second sliding ring 17 is slidably connected to the inner wall of the third sleeve pipe 20. An outer wall of the ring-shaped plate 45 is slidably connected to an inner wall of the first sliding ring 16.

When the connection female head 2 is not connected to the connection male head 3, under the action of the second spring 15 and the third spring 23, one end of the first sliding ring 16 and the side wall of the first push block 18 are in a same plane, an end portion of the second sliding ring 17 abuts against an inner side wall of the first push block 18, so that end portions of the connection female heads 2 are kept in a same plane, avoiding such impurities as dust to enter.

When the connection female head 2 is connected to the connection male head 3, the connection male head 3 pushes the first sliding ring 16 to move towards an interior of the connection female head 2. After moving for a certain distance, one end of the first sliding ring 16 is in contact with the ring-shaped plate 45 in the middle portion of the second sliding ring 17. The connection male head 3 continues to push to cause the second sliding ring 17 to continue to move towards the interior of the connection female head 2, so that the end portion of the second sliding ring 17 is separated from the side wall of the first push block 18. At this time, a connecting passage is formed inside the connection female head 2, facilitating the inflow of the cement paste.

In the present disclosure, the second spring 15 is sleeved on an outer side of the fourth sleeve pipe 21, a plurality of second springs 15 can also be arranged at equal intervals along a circumstance of the outer side of the fourth sleeve pipe 21, and the number of the second springs is at least two.

In the present disclosure, the third spring 23 is sleeved on an outer side of the second sliding ring 17, a plurality of third springs 23 can also be arranged at equal intervals along a circumstance of the outer side of the second sliding ring 17, and the number of the third springs is at least two.

In a further optimized solution, each of the connection male heads 3 includes a sixth sleeve pipe 36. A fifth sleeve pipe 31 is sleeved on an outer wall of the sixth sleeve pipe 36, one end of the fifth sleeve pipe 31 is fixedly connected to a second connection sleeve 30, and the second connection sleeve 30 is sleeved on an outer side of the sixth sleeve pipe 36. One end of the sixth sleeve pipe 36 is fixedly connected to a second push block 26, and the other end of the sixth sleeve pipe 36 is fixedly connected to a fixed support 37. An outer wall of the fixed support 37 is fixedly connected to an inner wall of the fifth sleeve pipe 31.

A center of the fixed support 37 is fixedly connected to a seventh sleeve pipe 38. An inner side of a middle portion of the seventh sleeve pipe 38 is fixedly connected to a fixed plate 40. One side of the fixed plate 40 is elastically connected to a connection part. One end of the connection part is slidably connected to an inner wall of the second push block 26. A lifting part is arranged on the other side of the fixed plate 40. One end of the lifting part is rotatably connected to the fixed plate 40, and the other end of the lifting part is fixedly connected to a second reinforcing steel joint 22. The second reinforcing steel joint 22 penetrates through the fifth sleeve pipe 31. An outer wall of the second reinforcing steel joint 22 is slidably connected to the inner wall of the fifth sleeve pipe 31 and is fixedly connected to a wall-connecting plate 34. The wall-connecting plate 34 is positioned on an outer side of the fifth sleeve pipe 31, and the wall-connecting plate 34 is fixedly connected to the bottom of the shear wall member 1.

The inner wall of the second push block 26 is fixedly embedded with a second sealing ring 27. The second sealing ring 27 is slidably connected to one end of the connection part. An open hole is disposed on a side wall, close to the second reinforcing steel joint 22, of one end of the fifth sleeve pipe 31, and the open hole is threadedly connected to a screw piston 33.

Threads are arranged on an outer wall of the second connection sleeve 30 fixedly connected to one end of the fifth sleeve pipe 31. The second connection sleeve 30 can be fixedly connected to the first connection sleeve 9 via the threads, so that the connection female head 2 and the connection male head 3 are fixedly connected.

One side of the fixed plate 40 is elastically connected to the connection part, and one end of the connection part is slidably connected to the inner wall of the second push block 26. When the connection female head 2 is connected to the connection male head 3, the connection part moves towards an interior of the seventh sleeve pipe 38 under the action of the first push block 18. At the same time, the second push block 26 pushes against the first sliding ring 16, so that an end portion of the sixth sleeve pipe 36 extends into the connection female head 2. The outer wall of the sixth sleeve pipe 36 is slidably connected to the inner wall of the second sleeve pipe 10. A plurality of chutes also disposed on the outer wall of the sixth sleeve pipe 36, and the plurality of chutes are in one-to-one correspondence with the plurality of clamp beads 13, so that when the chutes disposed on the outer wall of the sixth sleeve pipe 36 correspond to the clamp beads 13 after the sixth sleeve pipe 36 extends into, the clamp beads 13 fall into the chutes disposed on the outer wall of the sixth sleeve pipe 36, so that the sliding ring 8 and the second sleeve pipe 10 can be moved relatively to each other, causing the first connection sleeve 9 to move towards the second connection sleeve 30.

The lifting part fixed on the other side of the fixed plate 40 makes the second reinforcing steel joint 22 to be slidably connected relatively to the fifth sleeve pipe 31, so that the spacing between the wall-connecting plate 34 fixedly connected to the outer wall of the second reinforcing steel joint 22 and an outer wall of the fifth sleeve pipe 31 is adjustable to facilitate leveling of the shear wall member 1.

In a further optimized solution, the connection part includes a sliding rod 28. The sliding rod 28 is slidably connected to the inner wall of the second push block 26 and the second sealing ring 27. A middle portion of the sliding rod 28 is fixedly connected to a limit ring 29, and the limit ring 29 is a conical cavity structure. The seventh sleeve pipe 38 is positioned between an inner wall of the limit ring 29 and an outer wall of the sliding rod 28, and the outer wall of the sliding rod 28 is fixedly connected to an inner wall of the seventh sleeve pipe 38. Fourth springs 39 are arranged between one end of the sliding rod 28 and the fixed plate 40, and two ends of each of the fourth springs 39 abut against one end of the sliding rod 28 and a side wall of the fixed plate 40.

When the first push block 18 pushes the sliding rod 28 to move, the sliding rod 28 also drives the limit ring 29 to move, so that the fourth spring 39 is compressed. There is a gap between a side wall of the limit ring 29 and an inner wall of the sixth sleeve pipe 36, so that after the connection female head 2 is connected to the connection male head 3, the connection female head 2 is internally connected to the connection male head 3, facilitating the cement paste to flow from the connection female 2 to the connection male head 3.

When the connection female head 2 is not connected to the connection male head 3, the sliding rod 28 extends under the action of the fourth spring 39, an end surface of the sliding rod 28 is flush with an end surface of the second push block 26, and one end of the limit ring 29 abuts against one end of the second push block 26, avoiding the sliding rod 28 from sliding out.

In a further optimized solution, the lifting part includes a threaded rod 43. One end of the threaded rod 43 is rotatably connected to the side wall of the fixed plate 40, and the other end of the threaded rod 43 is rotatably connected to a center of the fixed support 37. A middle portion of the threaded rod 43 is fixedly connected to a second bevel gear 42, the second bevel gear 42 is meshed with a first bevel gear 41, a middle portion of the first bevel gear 41 is fixedly connected to an adjustment pin 32, and the adjustment pin 32 penetrates through a side wall of the fifth sleeve pipe 31 and a side wall of the sixth sleeve pipe 36.

One side, close to the fixed support 37, of the threaded rod 43 is threadedly connected to a threaded sliding block 44, and a side wall of the threaded sliding block 44 is slidably connected to the inner wall of the seventh sleeve pipe 38. A protrusion is arranged at an edge portion of the threaded sliding block 44, and a chute is disposed at a corresponding position on the inner wall of the seventh sleeve pipe 38. The protrusion on the edge portion of the threaded sliding block 44 and the chute on the inner wall of the seventh sleeve pipe 38 are fitted to avoid the relative rotation between the threaded sliding block 44 and the seventh sleeve pipe 38, so that the threaded sliding block 44 can only slides along the inner wall of the seventh sleeve pipe 38. One side, away from the second bevel gear 42, of the threaded sliding block 44 is fixedly connected to a plurality of push rods 25 at equal intervals along a circumference, and the push rods 25 penetrate through the fixed support 37. End portions of the plurality of push rods 25 are fixedly connected to one side of a same third sliding block 35. A side wall of the third sliding block 35 is slidably connected to the inner wall of the fifth sleeve pipe 31, and the other side of the third sliding block 35 is fixedly connected to the second reinforcing steel joint 22.

The adjustment pin 32 is rotatably connected to the side wall of the fifth sleeve pipe 31 and the side wall of the sixth sleeve pipe 36. When the shear wall member 1 needs to be leveled, the shear wall member 1 is connected to a fastening groove disposed on one end of an outer side of the adjustment pin 32 by means of a hand drill and other equipment to drive the adjustment pin 32 to rotate, causing the first bevel gear 41 to rotate and drive the second bevel gear 42 to rotate, and the second bevel gear 42 to drive the threaded rod 43 to rotate, and the threaded block 44 moves under the action of the thread. The third sliding block 35 slides inside the fifth sleeve pipe 31 by means of the push rod 25, causing the second reinforcing steel joint 22 to move, and causing the wall-connecting plate 34 away from or close to one end of the fifth sleeve pipe 31, thereby adjusting the level of the shear wall member 1.

It is worth noting that the fixed support 37 and the third sliding block 35 are both disposed with connection holes to facilitate the inflow of the cement paste and to fill up the internal space of the connection male head 3. The excessive cement paste flows out through the open hole at one end of the fifth sleeve pipe 31 close to the second reinforcing steel joint 22, and the open hole is subsequently plugged with the threaded piston 33.

A construction method for a fabricated concrete connection structure based on a fabricated concrete connection structure includes the following steps.

At S1: a shear wall member 1 is hoisted directly above the other shear wall member 1 to allow a plurality of connection female heads 2 to be in one-to-one correspondence with a plurality of connection male heads 3.

At S2: a height of the shear wall member 1 is lowered to allow a bottom of a folding plate 5 at a bottom of the shear wall member 1 to be in contact with a top of the other shear wall member 1, and the connection male heads 3 are inserted into the connection female heads 2 at the same time, followed by fixedly connecting the connection male heads 3 to the connection female heads 2.

When the connection female head 2 is connected to the connection male head 3, a second push block 26 of the connection male head 3 pushes a first sliding ring 16 to move towards an interior of the connection female head 2. After moving for a certain distance, one end of the first sliding ring 16 is in contact with a ring-shaped plate 45 in a middle portion of a second sliding ring 17. The second push block 26 of the connection male head 3 continues to push to cause the second sliding ring 17 to continue to move towards the interior of the connection female head 2, so that an end portion of the second sliding ring 17 is separated from a side wall of a first push block 18, and a connecting passage is formed inside the connection female head 2 at this time. When chutes disposed on an outer wall of the sixth sleeve pipe 36 correspond to clamp beads 13 after a sixth sleeve pipe 36 extends into, the clamp beads 13 fall into the chutes disposed on the outer wall of the sixth sleeve pipe 36, so that a sliding ring 8 and a second sleeve pipe 10 can be moved relatively to each other, and further, a first connection sleeve 9 is moved towards a second connection sleeve 30. The second connection sleeve 30 can be fixedly connected to the first connection sleeve 9 by means of threads to make the connection female head 2 and the connection male head 3 fixedly connected.

At S3: levelness of the shear wall member 1 is measured, and the shear wall member 1 is leveled by adjusting the plurality of connection male heads 3.

After measuring the levelness of the shear wall member 1, the shear wall member 1 is connected to a fastening groove by means of a hand drill or other equipment to drive an adjustment pin 32 to rotate, so that a first bevel gear 41 drives a second bevel gear 42 to rotate, and the second bevel gear 42 drives a threaded rod 43 to rotate. A threaded sliding block 44 is moved by means of threads. A third sliding block 35 slides inside a fifth sleeve pipe 31 by means of push rods 25, so that a second reinforcing steel joint 22 is moved, causing a wall-connecting plate 34 to move away from or close to one end of the fifth sleeve pipe 31, thereby adjusting the levelness of the shear wall member 1.

At S4: the shear wall member 1 is fixed by mounting a formwork on the shear wall member 1.

At S5: cement paste is injected into the connection female heads 2 and the connection male heads 3, and the formwork of the shear wall member 1 is removed after the cement paste solidifies.

After the upper and lower shear wall members 1 are connected, the cement paste is injected into joint re-formed holes 46 through injected holes 47 disposed on the lower shear wall member 1. After the joint pre-formed hole 46 is filled with the cement paste, the cement paste is filled into the connection female head 2 and the connection male head 3. The cement paste flows into the connection female head 2 through a hole on a side wall of a connection female head 6, and then flows into the connection male head 3 through the connection female head 2. The connection male head 3 is injected with the cement paste through a fixed support 37 of the connection male head 3 and a connection hole of a third sliding block 35. The excessive cement paste is discharged through an open hole, close to one end of the second reinforcing steel joint 22, of the fifth sleeve pipe 31, and after that, the open hole is plugged with a threaded piston 33. The formwork of the shear wall member 1 can be removed after the cement paste solidifies, thereby completing the preliminary connection of the shear wall member 1.

At S6: reinforcing cages are placed into reinforcing cage pre-formed holes 4.

At S7: the formwork is mounted at an edge of a gap between the upper and lower shear wall members 1, concrete is poured into the shear wall member 1 through the reinforcing cage pre-formed holes 4 to fill the gap between the two shear wall members 1, and the formwork is removed after the concrete solidifies to complete the construction.

The invention claimed is:

1. A fabricated concrete connection structure, comprising shear wall members (1), tops of the shear wall members (1) being fixedly connected to a plurality of connection female heads (2), and the plurality of connection female heads (2) being arranged at equal intervals along length directions of the shear wall members (1); a plurality of reinforcing cage pre-formed holes (4) being disposed on the shear wall members (1), the plurality of reinforcing cage pre-formed holes (4) being disposed at equal intervals along the length directions of the shear wall members (1), the plurality of reinforcing cage pre-formed holes (4) and the plurality of connection female heads (2) being arranged at intervals, and the reinforcing cage pre-formed holes (4) penetrating through the tops and bottoms of the shear wall members (1); a plurality of connection male heads (3) being arranged at the bottoms of the shear wall members (1), the plurality of connection male heads (3) being arranged at equal intervals along the length directions of the shear wall members (1), and the plurality of connection male heads (3) being in one-to-one correspondence with the plurality of connection female heads (2); and one side of the bottom of each of the shear wall members (1) being fixedly connected to a folding plate (5); wherein each of the connection female heads (2) comprises a female head connection seat (6), and the female head connection seat (6) is fixedly connected to the top of the shear wall member (1); and one side of the female head connection seat (6) is fixedly connected to a first reinforcing steel joint (11), the other side of the female head connection seat (6) is fixedly connected to a first sleeve pipe (7), a fastening part is sleeved on an outer side of the first sleeve pipe (7), and an inner wall of the fastening part is slidably connected to an outer wall of the first sleeve pipe (7);

a second sleeve pipe (10) is sleeved inside the first sleeve pipe (7), and an outer wall of the second sleeve pipe (10) is fixedly connected to an inner wall of the first sleeve pipe (7); a plurality of open grooves are disposed at one end of the second sleeve pipe (10), the plurality of open grooves are disposed at equal intervals along a circumference of the second sleeve pipe (10), a plurality of clamp beads (13) are connected inside the open grooves in a clamping mode, and the plurality of clamp beads (13) are connected to the fastening part in a clamping mode; and the outer wall of the second sleeve pipe (10) is slidably connected to the inner wall of the fastening part;

an inner wall of the second sleeve pipe (10) is slidably connected to a first sliding part, an inner wall of the first sliding part is slidably connected to a fourth sleeve pipe (21), and one end of the fourth sleeve pipe (21) is fixedly connected to a side wall of the female head connection seat (6);

an inner wall of the fourth sleeve pipe (21) is fixedly connected to a third sleeve pipe (20), an inner wall of the third sleeve pipe (20) is slidably connected to a second sliding part, a connection rod (19) is arranged in a center of the second sliding part, one end of the connection rod (19) is fixedly connected to a center of the side wall of the female head connection seat (6), the other end of the connection rod (19) is fixedly connected to a first push block (18), a side wall of the first push block (18) abuts against the second sliding part, and a top of one end of the second sliding part is slidably connected to the inner wall of the first sliding part; and a first sealing ring (24) is arranged on the inner wall of the third sleeve pipe (20), and the first sealing ring (24) is arranged in contact with a side wall of the second sliding part.

2. The fabricated concrete connection structure according to claim 1, wherein the fastening part comprises a sliding ring (8), one end of the sliding ring (8) being fixedly connected to a first connection sleeve (9); a middle portion of the sliding ring (8) abutting against one ends of first springs (14), and the other ends of the first springs (14) abutting against an end portion of the first sleeve pipe (7); an inner wall of the sliding ring (8) being slidably connected to the outer wall of the first sleeve pipe (7); an inner wall, away from the first sleeve pipe (7), of one side of the sliding ring (8) being slidably connected to the outer wall of the second sleeve pipe (10); and a plurality of keep-space grooves being disposed at equal intervals along a circumference at one end, away from the first sleeve pipe (7), of the sliding ring (8), the plurality of keep-space grooves being in one-to-one correspondence with the plurality of open grooves, and the keep-space groove being connected to the clamp bead (13) in a clamping mode.

3. The fabricated concrete connection structure according to claim 1, wherein the first sliding part comprises a first sliding ring (16), second springs (15) being arranged at one end of the first sliding ring (16), and two ends of each of the second springs (15) abutting against an end portion of the first sliding ring (16) and one side of the female head connection seat (6); an outer wall of the first sliding ring (16) being slidably connected to the inner wall of the second sleeve pipe (10); and an inner wall of the first sliding ring (16) being slidably connected to the top of one end of the second sliding part and being slidably connected to an outer wall of the fourth sleeve pipe (21).

4. The fabricated concrete connection structure according to claim 3, wherein the second sliding part comprises a second sliding ring (17), a ring-shaped plate (45) being sleeved outside the second sliding ring (17), the ring-shaped plate (45) being positioned at a middle portion of the second sliding ring (17), and the second sliding ring (17) being fixedly connected to the ring-shaped plate (45); and third springs (23) being arranged on one side of the ring-shaped plate (45), and two ends of each of the third springs (23) abutting against one end of the third sleeve pipe (20) and one side of the ring-shaped plate (45); an outer wall of the second sliding ring (17) being slidably connected to the inner wall of the third sleeve pipe (20); and an outer wall of the ring-shaped plate (45) being slidably connected to an inner wall of the first sliding ring (16).

5. The fabricated concrete connection structure according to claim 1, wherein each of the connection male heads (3) comprises a sixth sleeve pipe (36), a fifth sleeve pipe (31) being sleeved on an outer wall of the sixth sleeve pipe (36), one end of the fifth sleeve pipe (31) being fixedly connected to a second connection sleeve (30), and the second connection sleeve (30) being sleeved on an outer side of the sixth sleeve pipe (36); one end of the sixth sleeve pipe (36) being fixedly connected to a second push block (26), the other end of the sixth sleeve pipe (36) being fixedly connected to a fixed support (37), and an outer wall of the fixed support (37) being fixedly connected to an inner wall of the fifth sleeve pipe (31);

a center of the fixed support (37) being fixedly connected to a seventh sleeve pipe (38), an inner side of a middle portion of the seventh sleeve pipe (38) being fixedly connected to a fixed plate (40), one side of the fixed plate (40) being elastically connected to a connection part, and one end of the connection part being slidably connected to an inner wall of the second push block (26); a lifting part being arranged on the other side of the fixed plate (40), one end of the lifting part being rotatably connected to the fixed plate (40), the other end of the lifting part being fixedly connected to a second reinforcing steel joint (22), the second reinforcing steel joint (22) penetrating through the fifth sleeve pipe (31), an outer wall of the second reinforcing steel joint (22) being slidably connected to the inner wall of the fifth sleeve pipe (31) and being fixedly connected to a wall-connecting plate (34), the wall-connecting plate (34) being positioned on an outer side of the fifth sleeve pipe (31), and the wall-connecting plate (34) being fixedly connected to the bottom of the shear wall member (1); and the inner wall of the second push block (26) being fixedly embedded with a second sealing ring (27), and the second sealing ring (27) being slidably connected to one end of the connection part; and an open hole being disposed on a side wall, close to the second reinforcing steel joint (22), of one end of the fifth sleeve pipe (31), and the open hole being threadedly connected to a screw piston (33).

6. The fabricated concrete connection structure according to claim 5, wherein the connection part comprises a sliding rod (28), the sliding rod (28) being slidably connected to the inner wall of the second push block (26) and the second sealing ring (27), a middle portion of the sliding rod (28) being fixedly connected to a limit ring (29), the limit ring (29) being a conical cavity structure, the seventh sleeve pipe (38) being positioned between an inner wall of the limit ring (29) and an outer wall of the sliding rod (28), and the outer wall of the sliding rod (28) being fixedly connected to an inner wall of the seventh sleeve pipe (38); and fourth springs (39) being arranged between one end of the sliding rod (28) and the fixed plate (40), and two ends of each of the fourth springs (39) abutting against one end of the sliding rod (28) and a side wall of the fixed plate (40).

7. The fabricated concrete connection structure according to claim 5, wherein the lifting part comprises a threaded rod (43), one end of the threaded rod (43) being rotatably connected to the side wall of the fixed plate (40), and the other end of the threaded rod (43) being rotatably connected to the center of the fixed support (37); a middle portion of the threaded rod (43) being fixedly connected to a second bevel gear (42), the second bevel gear (42) being meshed with a first bevel gear (41), a middle portion of the first bevel gear (41) being fixedly connected to an adjustment pin (32), and the adjustment pin (32) penetrating through a side wall of the fifth sleeve pipe (31) and a side wall of the sixth sleeve pipe (36); and one side, close to the fixed support (37), of the threaded rod (43) being threadedly connected to a threaded sliding block (44), a side wall of the threaded sliding block (44) being slidably connected to the inner wall of the seventh sleeve pipe (38), one side, away from the second bevel gear (42), of the threaded sliding block (44) being fixedly connected to a plurality of push rods (25) at equal intervals along a circumference, the push rods (25) penetrating through the fixed support (37), end portions of the plurality of push rods (25) being fixedly connected to one side of a same third sliding block (35), a side wall of the third sliding block (35) being slidably connected to the inner wall of the fifth sleeve pipe (31), and the other side of the third sliding block (35) being fixedly connected to the second reinforcing steel joint (22).

8. A construction method for a fabricated concrete connection structure based on a fabricated concrete connection structure according to claim 1, comprising the following steps:

S1. hoisting a shear wall member (1) directly above the other shear wall member (1), and allowing a plurality of connection female heads (2) to be in one-to-one correspondence with a plurality of connection male heads (3);

S2. lowering a height of the shear wall member (1) to allow a bottom of the folding plate (5) at a bottom of the shear wall member (1) to be in contact with a top of the other shear wall member (1), and inserting the connection male heads (3) into the connection female heads (2) at the same time, followed by fixedly connecting the connection male heads (3) to the connection female heads (2);

S3. measuring levelness of the shear wall member (1), and leveling the shear wall member (1) by adjusting the plurality of connection male heads (3);

S4. fixing the shear wall member (1) by mounting a formwork on the shear wall member (1);

S5. injecting cement paste into the connection female heads (2) and the connection male heads (3), and removing the formwork of the shear wall member (1) after the cement paste solidifies;

S6. placing reinforcing cages into reinforcing cage pre-formed holes (4); and S7. mounting the formwork at an edge of a gap between the upper and lower shear wall members (1), pouring concrete into the shear wall member (1) through the reinforcing cage pre-formed holes (4) to fill the gap between the two shear wall members (1), and removing the formwork after the concrete solidifies to complete the construction.

9. A construction method for a fabricated concrete connection structure based on a fabricated concrete connection structure according to claim 2, comprising the following steps:

S1. hoisting a shear wall member (1) directly above the other shear wall member (1), and allowing a plurality of connection female heads (2) to be in one-to-one correspondence with a plurality of connection male heads (3);

S2. lowering a height of the shear wall member (1) to allow a bottom of the folding plate (5) at a bottom of the shear wall member (1) to be in contact with a top of the other shear wall member (1), and inserting the connection male heads (3) into the connection female heads (2) at the same time, followed by fixedly connecting the connection male heads (3) to the connection female heads (2);

S3. measuring levelness of the shear wall member (1), and leveling the shear wall member (1) by adjusting the plurality of connection male heads (3);

S4. fixing the shear wall member (1) by mounting a formwork on the shear wall member (1);

S5. injecting cement paste into the connection female heads (2) and the connection male heads (3), and removing the formwork of the shear wall member (1) after the cement paste solidifies;

S6. placing reinforcing cages into reinforcing cage pre-formed holes (4); and S7. mounting the formwork at an edge of a gap between the upper and lower shear wall members (1), pouring concrete into the shear wall member (1) through the reinforcing cage pre-formed holes (4) to fill the gap between the two shear wall members (1), and removing the formwork after the concrete solidifies to complete the construction.

* * * * *